US006074992A

United States Patent [19]

Levesque

[11] Patent Number: 6,074,992

[45] Date of Patent: Jun. 13, 2000

[54] FUNCTIONAL FLUID COMPOSITIONS

[75] Inventor: Pierre Levesque, Cross Lanes, W. Va.

[73] Assignee: Union Carbide Chemicals & Plastics Technology Corporation, Danbury, Conn.

[21] Appl. No.: 09/241,935

[22] Filed: Feb. 2, 1999

[51] Int. Cl.[7] ..... C10M 133/44

[52] U.S. Cl. ..... 508/279; 508/280; 508/283

[58] Field of Search ..... 252/77; 508/279, 508/280, 283

[56] References Cited

U.S. PATENT DOCUMENTS

| | | | |
|---|---|---|---|
| 5,366,651 | 11/1994 | Maes et al. | 252/76 |
| 5,405,543 | 4/1995 | Otake et al. | 252/21 |
| 5,482,521 | 1/1996 | Avery et al. | 44/344 |
| 5,490,946 | 2/1996 | Beltzer et al. | 252/47 |
| 5,681,506 | 10/1997 | Pragnell | 252/405 |
| 5,723,060 | 3/1998 | Brahnke | 252/73 |
| 5,723,061 | 3/1998 | Ciardi | 252/79 |

FOREIGN PATENT DOCUMENTS

| | | |
|---|---|---|
| 1108683 | 9/1995 | China . |
| 682022 | 11/1995 | European Pat. Off. . |
| 1271874 | 7/1964 | Germany . |
| 2600879 | 7/1976 | Germany . |
| 59/157188 | 9/1984 | Japan . |
| 07173651 | 7/1995 | Japan . |
| 1111680 | 5/1968 | United Kingdom . |
| 9529214 | 11/1995 | WIPO . |

OTHER PUBLICATIONS

"The chemistry of azole copper corrosion inhibitors in cooling water", Hollander and May, *Corrosion,* Jan. 1985, pp. 39–45.

"A study of alkylthiomethylbenzotriazoles as multifunctional lubricating of additives", T. Ren et al., *Lubri.Sci.* (1995) 7(2), pp. 163–169.

*Primary Examiner*—Jacqueline V. Howard
*Assistant Examiner*—Cephia D. Toomer
*Attorney, Agent, or Firm*—G. T. Hampilos

[57] ABSTRACT

Functional fluids comprising at least one compound selected from the group consisting of a glycol, a glycol ether, an ester, a hydrocarbon, and mixtures thereof and an effective amount of benzotriazole, a derivative thereof such as tolyltriazole or mixtures thereof and 1,2,4-triazole, a derivative thereof or mixtures thereof. The functional fluids exhibit increased resistance to corrosion and reduced sediment formation and are useful as brake fluids.

10 Claims, No Drawings

FUNCTIONAL FLUID COMPOSITIONS

FIELD OF THE INVENTION

This invention relates to functional fluids which are useful in a wide variety of applications such as brake fluids, hydraulic fluids, engine coolants, transmission fluids, lubricants, metal-working fluids, and the like, and to additives used in such fluids to protect against corrosion, staining and sediment formation and to provide long term heat stability.

BACKGROUND OF THE INVENTION

When used in applications such as brake fluids, functional fluids are typically exposed to metal surfaces including copper, zinc, aluminum and brass and to rubber parts, often under extreme conditions such as elevated temperatures leading to problems such as corrosion, oxidation and sediment formation. Higher under-the-hood temperatures in modern cars and trucks, the advent of antilock braking systems, and the desire for longer intervals between service visits has created a demand for high performance functional fluids with better resistance to corrosion, sediment formation and degradation over long periods of use.

Functional fluids typically comprise a base fluid containing glycols, glycol ethers, esters including borate esters and phosphate esters, ethoxylated or propoxylated alcohols, hydrocarbons and the like and a package of additives specifically designed to provide protection against corrosion of various metals, sediment formation and degradation. A variety of compounds are well recognized in the art as being useful as antioxidants, corrosion inhibitors etc., in functional fluids including certain triazole compounds. For example, amino-substituted 1,2,4 triazoles are disclosed in British Patent No. 1,111,680 as being a useful additive in ester based lubricant compositions. While these amino-substituted triazoles, exhibit good corrosion resistance for some metals, the data in Table II indicates some deficiencies in connection with copper and sediment formation.

Benzotriazole and its derivatives, in particular tolyltriazole are also recognized for their copper corrosion inhibiting properties and have been used as corrosion inhibitors in brake fluids . However, as pointed out in Japanese Kokai No. 59-157,188,these compounds are deficient in inhibiting copper corrosion and the formation of sediment in brake fluids. The Japanese Kokai patent suggests that the deficiencies of benzotriazole and its derivatives can be overcome by combining the triazole with one or more thiadiazole compounds. This combination, while effective in reducing sediment formation and inhibiting copper corrosion has the disadvantage of introducing a sulfur containing compound into the brake fluid which may have a negative effect on the long term heat stability of the fluid.

SUMMARY OF THE INVENTION

According to the present invention, applicants have discovered that a unique combination of two specific types of triazole compounds, when used together, can provide functional fluids with an excellent balance of properties including superior resistance to corrosion, oxidation and sediment formation while maintaining long term heat stability. More specifically, the present invention relates to functional fluids, particularly those useful as brake fluids, which contain an effective amount of benzotriazole, a derivative thereof such as tolyltriazole or mixtures thereof and 1,2,4-triazole, a derivative thereof or mixtures thereof. The superior balance of properties exhibited by the functional fluids containing the mixture of triazoles of the present invention can be achieved with a minimum amount of total triazole compound being present.

DESCRIPTION OF THE INVENTION

The functional fluids of the present invention comprise a base fluid the composition of which will be determined by the intended use of the functional fluid and a package of additives specifically designed to provide protection against corrosion, sediment formation and degradation over long periods of use. Base fluids useful in the functional fluids of the present invention are well known and normally comprise predominant amounts of one or more compounds selected from glycols, such as ethylene glycol, diethylene glycol, triethylene glycol, polyethylene glycol, propylene glycol, as well as polymeric derivatives and mixtures thereof; glycol ethers such as di, tri and tetra glycol ethers of methyl, ethyl, propyl, butyl or hexyl, for example ethyl diglycol ether, butyl diglycol ether, methoxytriglycol, ethoxytriglycol, butoxytriglycol, methoxytetraglycol, butoxytetrasglycol and the like; esters, including borate esters such as, but not limited to triethylene glycol monomethyl ether borate ester or tetraethylene glycol monomethyl ether borate ester and phosphate esters such as tricresyl phosphate ester, triphenyl phosphate ester, substituted phenol phosphate ester or alkyl phosphate esters and the like. In addition, mixtures of glycols with glycol ethers and/or borate esters or phosphate esters could be used, if desired. For applications such as lubricants, transmission fluids and the like, the base fluid could be a hydrocarbon. Selection of an appropriate base fluid in the preparation of the functional fluids of the present invention for any particular application is well within the skill of the experienced formulator.

The unique combination of triazole compounds which are added to a base fluid to provide the functional fluids of the present invention which exhibit superior resistance to corrosion, oxidation and sediment formation while providing long term heat stability is defined as a mixture containing an effective corrosion inhibiting amount of (a) benzotriazole, its derivatives and mixtures thereof and (b) 1,2,4 triazole and its derivatives and mixtures thereof The benzotriazole and its derivatives useful in this invention may be represented by the formula

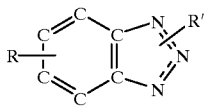

wherein R and R' are the same or different and can be hydrogen, an alkyl group containing from 1 to 8 carbon atoms, an amino group such as —NH, —NHR or —NR R', an acyl group such as —COR, or an aryl group such as benzene or toluene. Benzotriazole and tolyltriazole or mixtures thereof are particularly useful in the functional fluids of the present invention.

The 1,2,4 triazole or its derivatives useful in the present invention may be represented by the formula

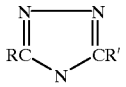

wherein R and R' are the same or different and can be hydrogen, an alkyl group containing from 1 to 8 carbon atoms, an amino group such as —NH, —NHR or —NR R', an acyl group such as —COR, or an aryl group such as benzene or toluene. 1,2,4 triazole is particularly useful in the functional fluids of the present invention Each of the triazoles of (a) and (b) should be present in the functional fluids of the present invention in an amount sufficient to provide an optimum balance of properties including effective resistance to corrosion, oxidation and sediment formation while providing long term heat stability. The amount of each type of triazole used is not narrowly critical and it is well within the expertise of a skilled formulator to optimize the amounts for each functional fluid application. The concentration of each of the triazoles of (a) and (b) can be in the range of about 0.01% to about 0.4%, preferably about 0.02% to about 0.2%, by weight based on the total weight of the functional fluid. The total combined weight of the triazoles of (a) and (b) present in the functional fluid should be in the range of about 0.05% to about 0.5% by weight based on the total weight of the functional fluid and preferably within the range of about 0.05% to about 0.3%. While the ratio of the amount of triazole (a) present to the amount of triazole (b) present is not critical, it will normally be in the range of about 1 to 4 to about 4 to 1. As will be readily understood by those skilled in the art of formulating functional fluids, the concentrations of the two types of triazoles ultimately utilized will be determined by the composition of the functional fluid and a balance between optimum performance and economic considerations.

Other materials which may advantageously be employed in combination with the triazoles in the functional fluids of the present invention include diazoles, thiazoles, amines, phenols, polymerized hydroquinoline, and inorganic salts such as nitrates, among others, all well known in the art for improving the overall performance of the fluid by functional contributions such as pH control, resistance to oxidation, etc. The instant claims are intended to encompass such materials and any synergistic effects that may result from such materials in combination with the mixture of two types of triazoles of this invention. It is also to be noted that while thiazoles are not expressly excluded, it is an advantage of the functional fluids of the present invention that excellent resistance to corrosion and sediment formation and heat stability is obtained without the potential problems which may be introduced by the presence of a sulfur containing thiazole compounds.

As will be illustrated in the examples which follow, the present invention provides improved protection against corrosion of copper, copper-based alloys (e.g., brass) and zinc, as well as improved appearance of such materials in service. In addition, the present invention provides superior protection against chloride corrosion for metals such as zinc, and reduces sediment formation resulting from exposure of the functional fluids to metals such as copper and its alloys and other materials such as rubber.

EXAMPLES

The following examples, which are not intended to be limiting, illustrate the invention and certain preferred embodiments thereof. As used in the Examples, the abbreviation "HBF" means Hydraulic Brake Fluid. The abbreviations "DOT 3" and "DOT 4" mean Department of Transportation type 3 and 4 brake fluid, respectively. The SAE Corrosion Test was conducted as prescribed by the Society of Automotive Engineering standard J 1703 (January 1995). The Copper Coil test is a Union Carbide procedure and was conducted as follows: To 95 ml of the brake fluid in a sample jar, 5 ml of NaCl/water solution were added and the mixture swirled. The resulting brake fluid contained 5% by volume water and 50 parts per million chloride ion. A copper coil, made from 5 meters of 1 mm diameter copper wire, was then added to the fluid and the sample jar lid attached. The sample test jar containing the brake fluid/water/chloride mixture and the copper coil was then placed in an oven at 100° C. for seven days. At the end of seven days the sample jar was removed, the fluid cooled to room temperature and the copper coil was examined. The copper appearance, quantity of dissolved copper and the amount of sediment were determined.

The functional fluids tested were prepared from either HBF DOT 3 or HBF DOT 4 base fluids. The HBF Dot 3 base fluid contained about 80% by weight, based on the total weight of the fluid composition, of glycol ethers such as methyl and butyl triethylene glycol ether and about 20% of a glycol such as triethylene glycol, the remainder, about 1%, being an additives package composed of a nitrate, phenolic antioxidant and alkanol amine. The HBF DOT 4 base fluid contained about 45% by weight, based on the total weight of the fluid composition, of methoxytriglycol borate ester, about 45% of glycol ethers such as methyl and butyl triethyleneglycol ether, about 10% of a glycol such as diethyleneglycol, the remainder, about 1%, being an additive package composed of a nitrate, a phenolic antioxidant and an alkanol amine. A triazole or a mixture of triazoles was added to the base fluids of the compositions tested. Fluid compositions containing a mixture of triazoles in accordance with the present invention were tested and compared to fluid compositions containing a single triazole. The results of the SAE Corrosion test, all of which were conducted in the prresence of 100 ppm added chlorides, are reported in Table 1 for DOT 3 fluid and in Table 2 for DOT 4 fluid. SAE accepted limits for the copper, brass and zinc strip weight change is ±0.4 mg/cm2 maximum. The results of the Copper Coil test are reported in Tables 3, 4 and 5.

TABLE 1

| | | SAE Corrosion test (100 ppm Cl— added) | |
|---|---|---|---|
| Fluid Type | Additives | Copper and brass strips | Zinc |
| HBF DOT 3 | benzotriazole at 0.15 wt % | Shiny strips weight change 0.0 mg/cm$^2$ | Stained strip; weight change −2.0 mg/cm$^2$ |
| HBF DOT 3 | Tolyltriazole at 0.15 wt % | Strips shiny or slight stain, weight change -0.02 to −0.09 mg/cm$^2$ | Stained strip; weight change −1.7 mg/cm$^2$ |
| HBF DOT 3 | 1,2,4-triazole at 0.15 wt % | Slight stained strips; wt change +0.01 to +0.04 mg/cm$^2$ | Slight stained strip; wt change +0.13 mg/cm$^2$ |
| HBF DOT 3 | Tolyltriazole at 0.20 wt % and 1,2,4-triazole at 0.20 wt % | Shiny or slight stain on strips; weight change from −0.05 to −0.09 mg/cm$^2$ | Stained strip; weight change +0.28 mg/cm$^2$ |
| HBF | Tolyltriazole at | Shiny strips; weight | Slight stained |

TABLE 1-continued

| Fluid Type | Additives | SAE Corrosion test (100 ppm Cl— added) Copper and brass strips | Zinc |
|---|---|---|---|
| DOT 3 | 0.05 wt % and 1,2,4-triazole at 0.20 wt% | change from 0 to −0.02 mg/cm$^2$ | strip; weight change +0.07 mg/cm$^2$ |
| HBF DOT 3 | 0.05% tolyltriazole + 0.10% 124-triazole | Shiny strips; weight change from −0.03 to −0.05 mg/cm$^2$ | Slight stained strip; weight change −0.09 mg/cm$^2$ |
| HBF DOT 3 | 0.03% tolyltriazole + 0.06% 124-triazole | Shiny strips; weight change from −0.01 to −0.05 mg/cm$^2$ | Slight stained strip; weight change −0.06 mg/cm$^2$ |
| HBF DOT 3 | 0.015% tolyltriazole + 0.03% 124-triazole | Shiny strips; weight change from −0.08 to −0.12 mg/cm$^2$ | Slight stained strip; weight change −0.11 mg/cm$^2$ |

TABLE 2

| Fluid Type | Additives | SAE Corrosion test (100 ppm Cl— added) Copper and brass strips | Zinc |
|---|---|---|---|
| HBF DOT 4 | Tolyltriazole at 0.2% wt | Strips with stain or slight stain and weight change of −0.29 to −0.38 mg/cm$^2$ | Strip with sleight stain and weight change of −0.40 mg/cm$^2$ |
| HBF DOT 4 | 1,2,4-triazole at 0.15% wt | Stained to slight stained strips; wt change −0.12 to −0.14 mg/cm$^2$ | Stained strip; wt change +0.25 mg/cm$^2$ |
| HBF DOT 4 | Tolyltriazole at 0.08 wt % and 1,2,4-triazole at 0.02 wt % | shiny strips, weight change from −0.02 to −0.04 mg/cm$^2$ | slight stain, weight change −0.30 mg/cm$^2$ |
| HBF DOT 4 | Tolyltriazole at 0.075 wt % and 1,2,4-triazole at 0.075 wt % | shiny or stained strips with weight change of −0.12 to −0.16 mg/cm$^2$ | strip with slight stain and weight change of 0.0 mg/cm$^2$ |
| HBF DOT 4 | 0.10% tolyltriazole + 0.10% 1,2,4-triazole | Stained to slight stained strips; wt change −0.12 to −0.19 mg/cm$^2$ | strip with slight stain and weight change of +0.04 mg/cm$^2$ |

TABLE 3

| Fluid Type | Additives | Copper Coil test Copper in solution (ppm) | Copper coil appearance | Sediments (% volume) |
|---|---|---|---|---|
| HBF DOT 3 | Tolyltriazole at 0.15 wt % | 30 to 100 | na | na (some particle detected; volume not measured) |
| HBF DOT 3 | 1,2,4-triazole at 0.15 wt % | 0 | clean, good, darker, no solid | none |
| HBF DOT 3 | Tolyltriazole at 0.20 wt % and 1,2,4-triazole at 0.20 wt % | 10 | Some coating on coil | na (some particle detected; volume not measured) |

TABLE 3-continued

| Fluid Type | Additives | Copper Coil test Copper in solution (ppm) | Copper coil appearance | Sediments (% volume) |
|---|---|---|---|---|
| HBF DOT 3 | Tolyltriazole at 0.05 wt % and 1,2,4-triazole at 0.20 wt % | 0 | Shiny coil | 0.1 |
| HBF DOT 3 | 0.05% tolyltriazole + 0.10 1,2,4-triazole | 20 | shiny coil | less than 0.1% |
| HBF DOT 3 | 0.03% tolyltriazole + 0.06% 1,2,4-triazole | 20 | shiny coil | less than 0.01% |
| HBF DOT 3 | 0.015% tolyltriazole + 0.03% 1,2,4-triazole | 35 | shiny coil | none |

TABLE 4

| Fluid Type | Additives | Copper Coil test Copper in solution (ppm) | Copper coil appearance | Sediments (% volume) |
|---|---|---|---|---|
| HBF DOT 4 | Tolyltriazole at 0.2% wt | 20 | gummy white coating | 3 |
| HBF DOT 4 | 1,2,4-triazole at 0.15% wt | 10 | clean, good, darker, no solid | none |
| HBF DOT 4 | Tolyltriazole at 0.08 wt % and 1,2,4-triazole at 0.02 wt % | 30 | some solid on coil | na |
| HBF DOT 4 | Tolyltriazole at 0.075 wt % and 1,2,4-triazole at 0.075 wt % | 5 | shiny copper (reddish) | 0 |
| HBF DOT 4 | 0.10% tolyltriazole + 0.10% 1,2,4-triazole | 10 | some solids | na |

TABLE 5

| Fluid Type | Additives | Copper Coil test Copper in solution (ppm) | Copper coil appearance | Sediments (% volume) |
|---|---|---|---|---|
| HBF DOT 3 | 0.01% wt Benzotriazole | 300 | green | 2 |
| HBF DOT 3 | 0.11% wt Benzotriazole | 5 | copper (reddish) | 8 |
| HBF DOT 3 | 0.11% wt Benzotriazole + 0.10% wt Tolyltriazole | 0 | copper (reddish) | 6 |
| HBF DOT 3 | 0.11% wt Benzotriazole + 0.10% wt 1,2,4-Triazole | 0 | green | 1 |

As can be seen from the data presented in Tables 1 to 5, the functional fluids of the present invention containing a mixture of two specific types of triazoles provide an excellent balance of properties including resistance to corrosion, oxidation and sediment formation.

What is claimed is:

1. A brake fluid, comprising a base fluid containing at least one compound selected from the group consisting of glycols, glycol ethers, esters, and hydrocarbons, in admixture with an effective corrosion inhibiting amount of (a) benzotriazole, its derivatives and mixtures thereof represented by the formula

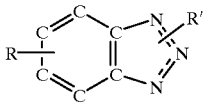

and (b) 1,2,4 triazole and its derivatives and mixtures thereof represented by the formula

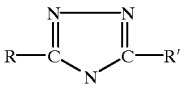

wherein in both (a) and (b) R and R' are the same or different and can be hydrogen, an alkyl group containing from 1 to 8 carbon atoms, an amino group, an acyl group, or an aryl group.

2. A brake fluid of claim 1 wherein (a) is benzotriazole, tolyltriazole or mixtures thereof and (b) is 1,2,4-triazole.

3. A brake fluid of claim 1 wherein (a) is benzotriazole, and (b) is 1,2,4-triazole.

4. A brake fluid of claim 1 wherein (a) is tolyltriazole and (b) is 1,2,4-triazole.

5. A brake fluid of claim 1 wherein at least one triazole contains alkyl or aryl substitution.

6. A brake fluid of claim 5 wherein said substitution comprises a an alkyl group containing 1 to 8 carbon atoms.

7. A brake fluid of claim 1 also containing one or more diazoles.

8. A brake fluid of claim 1 also containing one or more additives selected from the group consisting of amines, antioxidants, and inorganic salts.

9. A brake fluid of claim 1 wherein the base fluid contains a borate ester, a glycol ether, a glycol or a mixture thereof.

10. A brake fluid of claim 1 wherein each of the triazoles of (a) and (b) is present in an amount of from about 0.01% to about 0.4% by weight based on the total weight of the fluid.

* * * * *